US009195157B2

(12) United States Patent
Kawauchi et al.

(10) Patent No.: US 9,195,157 B2
(45) Date of Patent: Nov. 24, 2015

(54) CARRIER CORE PARTICLES FOR ELECTROPHOTOGRAPHIC DEVELOPER, CARRIER FOR ELECTROPHOTOGRAPHIC DEVELOPER, AND ELECTROPHOTOGRAPHIC DEVELOPER

(75) Inventors: Takeshi Kawauchi, Okayama (JP); Tomohide Iida, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 0 days.

(21) Appl. No.: 13/819,823

(22) PCT Filed: Mar. 2, 2012

(86) PCT No.: PCT/JP2012/055345

§ 371 (c)(1),
(2), (4) Date: Feb. 28, 2013

(87) PCT Pub. No.: WO2012/132759

PCT Pub. Date: Oct. 4, 2012

(65) Prior Publication Data

US 2014/0017609 A1 Jan. 16, 2014

(30) Foreign Application Priority Data

Mar. 31, 2011 (JP) ..... 2011-080263

(51) Int. Cl.

*G03G 9/10* (2006.01)
*G03G 9/107* (2006.01)
*G03G 9/113* (2006.01)

(52) U.S. Cl.

CPC ..... *G03G 9/1075* (2013.01); *G03G 9/10* (2013.01); *G03G 9/107* (2013.01); *G03G 9/113* (2013.01)

(58) Field of Classification Search

CPC ..... G03G 9/1075; G03G 9/10; G03G 9/107; G03G 9/113
USPC ..... 430/111.32, 111.33, 111.4
See application file for complete search history.

(56) References Cited

U.S. PATENT DOCUMENTS

| | | | | |
|---|---|---|---|---|
| 5,427,884 | A * | 6/1995 | Ohtani et al. | 430/108.14 |
| 2010/0028796 | A1 | 2/2010 | Nakamura et al. | |
| 2010/0119968 | A1 | 5/2010 | Komatsu et al. | |
| 2010/0143833 | A1 | 6/2010 | Baba et al. | |
| 2011/0195357 | A1* | 8/2011 | Sugiura et al. | 430/111.32 |

FOREIGN PATENT DOCUMENTS

| | | |
|---|---|---|
| EP | 2199864 | 6/2010 |
| EP | 2615499 | 7/2013 |
| JP | 2006-337828 | 12/2006 |

(Continued)

*Primary Examiner* — Peter Vajda
(74) *Attorney, Agent, or Firm* — Clark & Brody

(57) ABSTRACT

A method for manufacturing carrier core particles for electrophotographic developer including a slurrying step (A) of making an iron-containing raw material and a strontium-containing raw material into slurry, a granulation step (B) of granulating the slurry mixture obtained in the slurrying step, and a firing step (C) of firing a powdery material, which is obtained by granulating the slurry mixture in the granulation step, at a predetermined temperature to form a magnetic phase. The slurrying step makes the iron-containing raw material into the slurry containing the iron-containing raw material having a volume diameter $D_{50}$ of 1.0 to 4.0 μm and a volume diameter $D_{90}$ of 2.5 to 7.0 μm, and makes the strontium-containing raw material into the slurry so that the carrier core particles for electrophotographic developer contain $0<y\leq5000$ ppm, where y denotes the content of the strontium in the carrier core particles.

5 Claims, 2 Drawing Sheets

(56) References Cited

FOREIGN PATENT DOCUMENTS

| | | |
|---|---|---|
| JP | 2007-271662 | 10/2007 |
| JP | 2007-271663 | 10/2007 |
| JP | 2010-243798 | 10/2010 |
| JP | 2011-008199 | 1/2011 |

* cited by examiner

CARRIER CORE PARTICLES FOR ELECTROPHOTOGRAPHIC DEVELOPER, CARRIER FOR ELECTROPHOTOGRAPHIC DEVELOPER, AND ELECTROPHOTOGRAPHIC DEVELOPER

TECHNICAL FIELD

This invention relates to a method for manufacturing carrier core particles for electrophotographic developer (hereinafter, sometimes simply referred to as "carrier core particles"), the carrier core particles for electrophotographic developer, carrier for electrophotographic developer (hereinafter, sometimes simply referred to as "carrier"), and electrophotographic developer (hereinafter, sometimes simply referred to as "developer"). More particularly, this invention relates to carrier core particles contained in electrophotographic developer used in copying machines, MFPs (Multifunctional Printers) or other types of electrophotographic apparatuses, a method for manufacturing the carrier core particles, carrier in the electrophotographic developer and the electrophotographic developer.

BACKGROUND ART

Electrophotographic dry developing systems employed in copying machines, MFPs or other types of electrophotographic apparatuses are categorized into a system using a one-component developer containing only toner and a system using a two-component developer containing toner and carrier. In either of these developing systems, toner charged to a predetermined level is applied to a photoreceptor. An electrostatic latent image formed on the photoreceptor is rendered visual with the toner and is transferred to a sheet of paper. The image visualized by the toner is fixed on the paper to obtain a desired image.

A brief description about development with the two-component developer will be given. A predetermined amount of toner and a predetermined amount of carrier are accommodated in a developing apparatus. The developing apparatus is provided with a rotatable magnet roller with a plurality of south and north poles alternately arranged thereon in the circumferential direction and an agitation roller for agitating and mixing the toner and carrier in the developing apparatus. The carrier made of a magnetic powder is carried by the magnet roller. The magnetic force of the magnet roller forms a straight-chain-like magnetic brush of carrier particles. Agitation produces triboelectric charges that attract a plurality of toner particles to the surfaces of the carrier particles. The magnetic brush abuts against the photoreceptor with rotation of the magnet roller to supply the toner to the surface of the photoreceptor. Development with the two-component developer is carried out as described above.

Fixation of the toner on a sheet of paper results in successive consumption of toner in the developing apparatus, and new toner in the same amount as that of the consumed toner is supplied, whenever needed, from a toner hopper attached to the developing apparatus. On the other hand, the carrier is not consumed for development and is used as it is until the carrier comes to the end of its life. The carrier, which is a component of the two-component developer, is required to have various functions including: a function of triboelectrically charging the toner by agitation in an effective manner; insulation properties; and a toner transferring ability to appropriately transfer the toner to the photoreceptor. To improve the toner charging performance, the recent carrier is especially required to have appropriate electric resistance (hereinafter, sometimes simply referred to as "resistance") and appropriate insulation properties.

The recently dominating carrier includes carrier core particles, which are the core or the heart of the carrier particles, and coating resin that covers the outer surface of the carrier core particles.

Technologies relating to the carrier core particles and carrier particles are disclosed in, for example, Japanese Unexamined Patent Application Publication Nos. 2006-337828 (PTL 1) and 2011-8199 (PTL 2).

CITATION LIST

Patent Literature

PTL 1: JP-A No. 2006-337828
PTL 2: JP-A No. 2011-8199

SUMMARY OF INVENTION

Technical Problem

The carrier core particles are required to have good electrical characteristics, more specifically, for example, to be capable of holding a large amount of electric charges and having a high dielectric breakdown voltage. In addition, the carrier core particles are desired to have an appropriate resistance value as described above.

Especially, there has been a growing trend in recent years to require improvement of the charging performance of the carrier core particles, more specifically, an increase of the amount of charges the carrier core particles can hold. As described above, the carrier core particles are often coated with coating resin before use; however, stress or other forces caused by agitation in a developing apparatus may sometimes peel a part of the coating resin and resultantly expose the surfaces of the carrier core particles. Under that circumstance, it is strongly required that the exposed surfaces of the carrier core particles are triboelectrically charged through friction with toner. Of course, it is preferable that carrier core particles have good magnetic characteristics and other characteristics.

Toner particle size reduction has been recently proceeding from the viewpoint of enhancing image quality. Reduction in toner particle size encourages carrier particle size reduction and also carrier core particle size reduction. However, the reduction in carrier core particle size may create new issues.

Generally, the carrier core particles are obtained by mixing and granulating raw materials and firing the granulated materials to induce ferritization and crystal growth. However, the carrier core particles that are reduced in size through the steps tend to increase the surface variability. Specifically, the finer carrier core particles tend to provide more variability in dimension or size of crystals grown on the surfaces of the particles and easily create coarse crystals on the surfaces of the particles.

Such carrier core particles having large surface variability are generally regarded as having poor surface property and poor adhesion property with coating resin, which will be used to cover the particles in a later step. The poor adhesion property consequently shortens the life of carrier, by extension to developer, that is manufactured based on the carrier core particles.

PTL 1 discloses development of ferrite carrier core particles for electrophotographs, each particle having a surface divided into 2 to 50 segments per 10 μm square by grooves or streaks and mainly containing manganese ferrite. PTL 1 also describes that electrophotographic developer containing ferrite carrier made by coating the ferrite carrier core particles with resin exhibits quick charge rise and can stably hold charge over time.

However, the fine carrier core particles, more specifically, the carrier core particles having a volume mean diameter of approximately 25 μm may have many holes inside thereof and therefore be lower in strength even if the crystal size is controlled to fall in a predetermined range for the surface properties of the carrier core particles.

PTL 2 discloses carrier core particles in which the ratio between the intrusion pore volume and extrusion pore volume, obtained by mercury porosimetry, is restricted to 0.2 to 0.8. According to PTL 2, when carrier including the carrier core particles is used as developer, the carrier shows stabilized fluidity in a developing apparatus with time, prevents horizontal development irregularity in an image, maintains a certain leaking point even if the carrier core particles are covered with a certain amount of resin, and prevents charge amount rise, large charge variations and reduction of image density.

However, the values of the extrusion pore volume sometimes vary depending on, not the number of the pores, but on the shape of the pores, and therefore restriction of the aforementioned ratio may not be enough. Especially, the small-diameter carrier core particles often do not have pores of uniform shape on the surfaces; the only restriction of the ratio cannot prevent problems in the strength of the carrier core particles.

An object of the present invention is to provide a method for manufacturing carrier core particles for electrophotographic developer that are smaller in diameter and have crystals of appropriate size on the surfaces and high strength.

Another object of the present invention is to provide carrier core particles for electrophotographic developer that are smaller in diameter and have crystals of appropriate size on the surfaces and high strength.

Yet another object of the present invention is to provide carrier particles for electrophotographic developer that are smaller in diameter and have high strength.

Yet another object of the present invention is to provide electrophotographic developer capable of forming excellent quality images.

Solution to Problem

The inventors of the present invention first tried to reduce the particle size of raw materials of the carrier core particles in order to reduce the size of resultant carrier core particles. Then, the inventors expected that using raw materials whose volume diameter $D_{50}$ is small can, while reducing the size of the carrier core particles, improve the surface properties of the carrier core particles, in other words, control the crystal growth during a firing step to optimize the crystal size on the particle surfaces. However, the inventors found out that the use of the raw materials whose volume diameter $D_{50}$ is small causes acceleration of sintering speed in the firing step, and therefore it is difficult to control the sintering of the inside and outside of the carrier core particles. On the other hand, the use of raw materials having a large volume diameter $D_{50}$ is difficult to make the carrier core particles smaller in diameter and also decreases the filling ratio of the raw material per a particle when the raw materials are in the form of granulated powder, resulting in carrier core particles having large pores or holes. In addition, the inventors diligently examined the ways to control sintering by using additives that inhibit the sintering through conventional techniques; however, they found that the additives sometimes deteriorate the charging performance of the carrier core particles.

After keen examination, the inventors have focused attention not only on the value of volume diameter $D_{50}$ of the raw materials, but also coarse particles of the raw material and found out the possibility of controlling the sintering in the firing step, while preventing pore generation by restricting the value of volume diameter $D_{90}$ of the raw materials. Furthermore, the inventors conceived addition of a trace amount of strontium (Sr) to accelerate ferritization reaction and sintering at a mild pace without impairment of basic physical properties of the carrier core particles.

Thus, the method for manufacturing the carrier core particles for electrophotographic developer according to the invention is directed to a method for manufacturing carrier core particles including iron and strontium as a core composition. The method includes a slurrying step of making an iron-containing raw material and a strontium-containing raw material into slurry, a granulation step of granulating the slurry mixture obtained in the slurrying step, and a firing step of firing a powdery material, which is obtained by granulating the slurry mixture in the granulation step, at a predetermined temperature to form a magnetic phase. The slurrying step makes the iron-containing raw material into the slurry containing the iron-containing raw material having a volume diameter $D_{50}$ of 1.0 to 4.0 μm and a volume diameter $D_{90}$ of 2.5 to 7.0 μm. The slurrying step makes the strontium-containing raw material into the slurry so that the carrier core particles contain $0<y\leq5000$ ppm, where y denotes the content of the strontium in the carrier core particles for electrophotographic developer.

This manufacturing method can produce carrier core particles that are small in diameter, have very few pores therein and have uniform crystal grains thereon. Accordingly, the manufacturing method can produce carrier core particles for electrophotographic developer that are smaller in diameter, have crystals of appropriate size on the surfaces and high strength. Note that the volume diameters $D_{50}$, $D_{90}$ correspond to values at 50% and 90% points, respectively, on a cumulative curve determined on the total volume of the obtained powder expressed as 100%.

The carrier core particles having those compositions are first expressed by a general formula: $Mn_xFe_{3-x}O_{4+v}$ ($-0.003<v$). x is preferably $0.7\leq x\leq1.2$, and more preferably $0.8\leq x\leq1.1$. Carrier core particles in which x is 0.7 or higher are preferable because they can have high magnetization. Carrier core particles in which x is 1.2 or lower are preferable because excessive Mn can prevent the increase of the non-magnetic phase inside the particles.

In this case, the iron-containing raw material may be calcined in advance in the slurrying step.

Preferably, in the firing step, the material is fired at a firing temperature ranging from 1050° C. to 1180° C. for firing time ranging from 0.5 to 10 hours after reaching the firing temperature.

More preferably, the firing temperature is set in a range within 1085° C. to 1150° C., while the firing time is set in a range within 1.5 to 6 hours. The carrier core particles fired at a firing temperature of 1085° C. or higher for a firing time of 1.5 hours or longer undergo sufficient ferritization, while being gradually sintered inside and outside thereof, thereby obtaining target surface properties. Setting the firing temperature to 1150° C. or lower and firing time to 6 hours or shorter does not sinter the particles excessively and therefore does not create coarse crystals on the particle surfaces, which is preferable.

The oxygen concentration in a firing furnace can be set to any value, but should be enough to advance ferritization reaction. Specifically speaking, a gas is introduced and flows in the furnace to adjust the oxygen concentration to $10^{-7}$% to 3%.

In addition, the reduction atmosphere required for ferritization can be controlled by adjusting the amount of a reducing agent, which will be described later.

In another aspect of the present invention, carrier core particles for electrophotographic developer include iron and strontium as a core composition, and have a strontium content y of $0<y\leq5000$ ppm, a mean particle diameter ranging from 20 μm to 30 μm, a BET specific surface area ranging from 0.15 $m^2/g$ to 0.25 $m^2/g$, and a pore volume by mercury porosimetry ranging from 0.003 ml/g to 0.023 ml/g.

The carrier core particles having a strontium content of $0<y$, in other words, containing strontium, are preferable because the strontium gradually advances ferritization reaction and sintering for easy achievement of the target surface properties. In addition, the carrier core particles having $y\leq5000$ ppm strontium are preferable because an increase of remanent magnetization caused by generation of strontium ferrite is prevented. The carrier core particles having a BET specific surface area of 0.15 $m^2/g$ or higher and a pore volume by mercury porosimetry of 0.003 ml/g or higher are preferable because such particles have very few pores therein and have an improved adhesion property with coating resin due to their high BET specific surface area values provided by irregularities on the particle surfaces. In addition, the carrier core particles having a BET specific surface area of 0.25 $m^2/g$ or lower and a pore volume by mercury porosimetry of 0.023 ml/g or lower are preferable because such particles have very few large open pores, or holes having openings on the particle surface, and achieve the high BET specific surface area values mainly provided from minute or micro pores, thereby enhancing particle strength.

Let w ($m^2/g$) denote the BET specific surface area value and v (ml/g) the pore volume value by mercury porosimetry, it is preferable that the carrier core particles are prepared so as to establish the relationship $v\leq0.63w^2-0.084w+0.028$. The carrier core particles in which the BET specific surface area value and pore volume value by mercury porosimetry establish the relationship have very few pores therein, have uniform crystal grains thereon, and achieves further enhanced particle strength.

In a further preferable embodiment, carrier core particles have 500 ppm$<y\leq3400$ ppm strontium, a mean particle diameter ranging from 20 μm to 30 μm, a BET specific surface area ranging 0.15 $m^2/g$ to 0.20 $m^2/g$, a pore volume by mercury porosimetry ranging from 0.003 ml/g to 0.012 ml/g. Such carrier core particles for electrophotographic developer can more reliably achieve high BET specific surface area values, improved adhesion property with coating resin, and enhanced particle strength.

The present invention is also directed to carrier core particles for electrophotographic developer including iron and strontium as a core composition and manufactured by making an iron-containing raw material and strontium-containing raw material into slurry, granulating the obtained slurry mixture, and firing the granulated powdery material at a predetermined temperature to form a magnetic phase. The carrier core particles for electrophotographic developer are manufactured by making the iron-containing raw material into the slurry containing the iron-containing raw material having a volume diameter $D_{50}$ of 1.0 to 4.0 μm and a volume diameter $D_{90}$ of 2.5 to 7.0 μm, and by making the strontium-containing raw material into the slurry so that the carrier core particles contain $0<y\leq5000$ ppm, where y denotes the content of the strontium in the carrier core particles for electrophotographic developer.

The carrier core particles for electrophotographic developer are small in diameter, have very few pores therein, and have uniform crystal grains thereon. Accordingly, the carrier core particles for electrophotographic developer, which are manufactured by the manufacturing method, can be smaller in diameter and have crystals of appropriate size on the surfaces and high strength.

In yet another aspect of the invention, carrier for electrophotographic developer used in electrophotographic developer includes any of the aforementioned carrier core particles for electrophotographic developer and resin that coats the surface of the carrier core particles for electrophotographic developer.

The carrier for electrophotographic developer can be smaller in diameter and have high strength.

In yet another aspect of the present invention, electrophotographic developer used to develop electrophotographic images includes the carrier for electrophotographic developer and toner that can be triboelectrically charged by frictional contact with the carrier for development of electrophotographic images.

The electrophotographic developer including the carrier for electrophotographic developer having the aforementioned composition can form high quality images.

Advantageous Effects of Invention

The manufacturing method can produce carrier core particles that are small in diameter, have very few pores therein, and uniform crystal grains thereon. Accordingly, the manufacturing method can produce carrier core particles for electrophotographic developer that are smaller in diameter, have crystals of appropriate size on the surfaces and high strength.

In addition, the carrier core particles are smaller in diameter, have very few pores therein, and uniform crystal grains thereon. Accordingly, the manufacturing method can produce carrier core particles for electrophotographic developer that are smaller in diameter, have crystals of appropriate size on the surfaces and high strength. Accordingly, the carrier core particles manufactured by the method for manufacturing the carrier core particles can be smaller in diameter and have crystals of appropriate size on the surfaces and high strength.

In addition, the carrier for electrophotographic developer according to the invention can be smaller in diameter and achieve high strength.

The electrophotographic developer according to the invention can form high quality images.

DESCRIPTION OF EMBODIMENTS

An embodiment of the present invention will be described below with reference to the drawings. First, a description about carrier core particles according to the embodiment of the invention will be given. The carrier core particles according to the embodiment of the invention are roughly spherical in shape. The carrier core particles according to the embodiment have a diameter of approximately 25 μm and an appropriate particle size distribution. Specifically, the particle diameter refers to volume mean diameter. The particle diameter and particle size distribution are set to any values to meet required characteristics and manufacturing yield of the developer. On the surface of the carrier core particles, there are fine irregularities that are formed mainly in a firing step, which will be described later.

Carrier particles according to the embodiment of the invention are also roughly spherical in shape like the carrier core particles. The carrier particles are made by coating, or covering, the carrier core particles with a thin resin film and have almost the same diameter as the carrier core particles. The surfaces of the carrier particles are almost completely covered with resin, which is different from the carrier core particles.

Developer according to the embodiment of the invention includes the aforementioned carrier and toner. Toner particles are also roughly spherical in shape. The toner particles contain mainly styrene acrylic-based resin or polyester-based resin and a predetermined amount of pigment, wax and other ingredients combined therewith. Such toner particles are manufactured by, for example, a pulverizing method or polymerizing method. The toner particles in use are, for example, approximately 5 μm in diameter, which is about one-seventh of the diameter of the carrier particles. The compounding ratio of the toner and carrier is also set to any value according to the required developer characteristics. Such developer is manufactured by mixing a predetermined amount of the carrier and toner by a suitable mixer.

Figure 1:
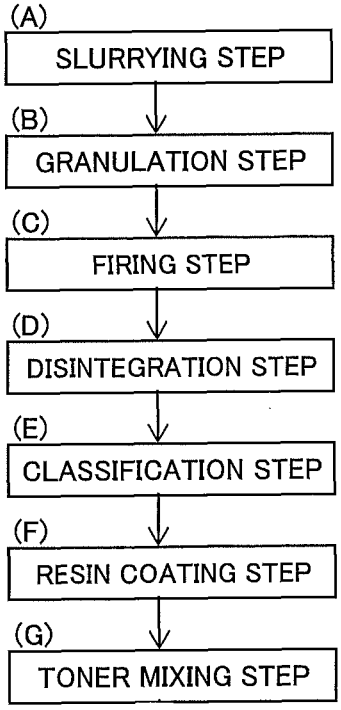
FIG. 1 is a flow chart showing main steps of a method for manufacturing carrier core particles according to an embodiment of the invention.

Next, a method for manufacturing the carrier core particles according to the embodiment of the invention will be described. FIG. 1 is a flow chart showing main steps of the method for manufacturing the carrier core particles according to the embodiment of the invention. Along FIG. 1, the method for manufacturing the carrier core particles according to the embodiment of the invention will be described below.

First, a raw material containing iron, a raw material containing manganese and a raw material containing strontium are prepared. The prepared raw materials are formulated at an appropriate compounding ratio to meet the required characteristics, mixed and pulverized to make slurry (FIG. 1(A)). The appropriate compounding ratio in this embodiment is set so that the resultant carrier core particles are made at the compounding ratio.

The iron-containing raw material making up the carrier core particles according to the embodiment of the invention can be metallic iron or an oxide thereof, and more specifically, preferred materials include $Fe_2O_3$, $Fe_3O_4$ and Fe, which can stably exist at room temperature and atmospheric pressure. The manganese-containing raw material can be manganese metal or an oxide thereof, and more specifically, preferred materials include Mn metal, $MnO_2$, $Mn_2O_3$, $Mn_3O_4$ and $MnCO_3$, which can stably exist at room temperature and atmospheric pressure. In addition, preferred strontium-containing raw materials include $SrCO_3$, $Sr(NO_3)_2$, and $SrSO_4$, and more preferred one is $SrCO_3$. Each of the raw materials (iron raw material, manganese raw material, strontium raw material, etc.) or the raw materials mixed so as to have the target composition may be calcined and pulverized before use. Among the aforementioned raw materials, it is preferable to calcine and pulverize only the iron-containing raw material and manganese-containing raw material to use as a calcined raw material, but it is preferable not to calcine $SrCO_3$ as a strontium-containing raw material. Non-calcined $SrCO_3$ undergoes first a decomposition reaction during a firing step, which will be described later, and then a ferritization reaction and sintering. Because of this, if the raw materials to be calcined do not contain $SrCO_3$, the raw materials will undergo first a decomposition reaction during the after-mentioned firing step and then a ferritization reaction and sintering. Thus, the ferritization reaction and sintering can be advanced at a mild pace, thereby providing small-diameter carrier core particles with uniform crystal grains on the surfaces.

The iron-containing raw material used herein has a volume diameter $D_{50}$ of 1.0 to 4.0 μm and a volume diameter $D_{90}$ of 2.5 to 7.0 μm. The strontium-containing raw material used herein has also a volume diameter $D_{50}$ of 1.0 to 4.0 μm and a volume diameter $D_{90}$ of 2.5 to 7.0 μm. The manganese-containing raw material used herein has a volume diameter $D_{50}$ of 0.1 to 3.0 μm and a volume diameter $D_{90}$ of 1.0 to 6.0 μm.

When the content of strontium in the raw material is represented by y, the strontium content is expressed by $0<y\leq5000$ ppm.

Specifically, in order to have a predetermined composition, the iron-containing raw material and manganese-containing raw material are mixed and pelletized in a vibratory ball mill and the pelletized materials are calcined at 800° C. to 1050° C. for 1 to 10 hours. Pelletizing the raw materials is preferable because the pellets partially undergo a ferritization reaction even in the temperature range from 800° C. to 1050° C. More preferably, the temperature range is set to 900° C. to 1000° C. because 900° C. or higher can sufficiently accelerate the partial ferritization reaction and 1000° C. or lower can prevent the pellets from excessive sintering, thereby facilitating formation of the raw materials into particles having target sizes in later steps. The calcined materials obtained through the step are pulverized by a vibration mill to adjust their sizes to certain particle sizes.

Then, the mixed materials are pulverized into fine particles and slurried. Specifically, the materials are weighted to meet the target composition of the carrier core particles, mixed and pulverized by a wet bead mill to obtain a slurried material with a target particle size. In this step, the ratio of coarse particles in the material is controlled. Specifically, the iron-containing material is made into slurry so as to have a volume diameter $D_{50}$ of 1.0 to 4.0 μm and a volume diameter $D_{90}$ of 2.5 to 7.0 μm. Let y denote the content of strontium in the carrier core particles, the strontium-containing material is made into slurry so that the carrier core particles contain $0<y\leq5000$ ppm strontium. The iron-containing material having a volume diameter $D_{90}$ of 2.5 μm or higher is preferable because the material does not exhibit a sharp particle size distribution and undergoes sintering at a mild speed, thereby easily being controlled to obtain target surface properties. Besides, the iron-containing material having a volume diameter $D_{90}$ of 7.0 μm or lower is preferable because the material becomes carrier core particles with the reduced number of pores, which are often seen in coarse particles.

In the manufacturing step of the method for manufacturing the carrier core particles according to the invention, a reduction agent may be further added to the aforementioned slurried material to accelerate a reduction reaction to be induced in a part of a firing step, which will be described later. A preferred reducing agent may be carbon powder, polycarboxylic acid-based organic substance, polyacrylic acid-based organic substance, maleic acid, acetic acid, polyvinyl alcohol (PVA)-based organic substance, or mixtures thereof.

Water is added to the slurried material that is then mixed and agitated so as to adjust the solid concentration to 60 wt % or higher, preferably 70 wt % or higher. The slurried material containing 70 wt % of solids or higher is preferable because such a material can maintain strength when it is granulated into pellets, and can be carrier core particles with the reduced number of pores therein after the firing step and therefore with enhanced strength.

Subsequently, the slurried material is granulated (FIG. 1(B)). Granulation of the slurry obtained by mixing and agitation is performed with a spray drier. Note that it may be preferable to subject the slurry to wet pulverization before the granulation step.

The temperature of an atmosphere during spray drying can be set to approximately 100° C. to 300° C. This can provide granulated powder whose particles are approximately 10 to 200 μm in diameter. In consideration of the final diameter of the particles as a product, it is preferable to filter the obtained granulated powder by a vibrating sieve or the like to remove coarse particles and fine powder for particle size adjustment at this point of time.

Subsequently, the granulated material is fired (FIG. 1(C)). Specifically, the obtained granulated powder is placed in a furnace heated to approximately 1050° C. to 1180° C. as firing temperatures and fired for 0.5 to 10 hours to produce a target fired material. During firing, the oxygen concentration in the firing furnace can be set to any value, but should be enough to advance ferritization reaction. Specifically speaking, a gas is introduced and flows in the furnace to adjust the oxygen concentration to from $10^{-7}$% to 3%.

More specifically, the firing step is performed under the conditions: a temperature rising rate of from 0.5° C./min to 100° C./min.; a firing temperature of from 1050° C. to 1180° C.; a firing time after reaching the firing temperature of from 0.5 to 10 hours; and a cooling rate from the firing temperature of from 0.5° C./min to 10° C./min.

More preferably, the firing temperature is set to a range of 1085° C. to 1150° C., and the firing time is set to a range of 1.5 to 6 hours. A firing temperature of 1085° C. or higher and firing time of 1.5 hours or longer sufficiently accelerate ferritization and sinter the inside and outside of the particles at a mild pace, thereby obtaining the target surface properties. A firing temperature of 1150° C. or lower and firing time of 6 hours or shorter do not excessively sinter the particles, thereby preferably preventing coarse crystal generation on the particle surfaces.

A reduction atmosphere required for ferritization can be achieved in the furnace by adjusting the amount of the reducing agent or other factors.

Furthermore, in the firing step, exhaust gas generated during firing, especially $CO_2$ gas, needs to be controlled to flow, without remaining in the furnace, in order to maintain the $CO_2$ concentration to be low. Maintaining the $CO_2$ gas to be low considerably retards a decomposition reaction and ferritization reaction of $SrCO_3$, thereby preferably preventing the carrier core particles from losing the strength even if sintering is delayed inside the particles.

It is preferable at this stage to control the particle size of the fired material. For example, the fired material is coarsely ground by a hammer mill or the like. In other words, the fired granules are disintegrated (FIG. 1(D)). After disintegration, classification is carried out with a vibrating sieve or the like. In other words, the disintegrated granules are classified (FIG. 1(E)). Through the steps, carrier core particles having a desired size can be obtained.

Then, the classified granules undergo oxidation (FIG. 1(F)). The surfaces of the carrier core particles obtained at this stage are heat-treated (oxidized) to increase the particle's breakdown voltage to 250 V or higher, thereby imparting appropriate electric resistance of $1\times10^{6}$ to $1\times10^{13}$ Ω·cm to the carrier core particles. Increasing the electric resistance of the carrier core particles through oxidation results in reduction of carrier scattering caused by charge leakage.

More specifically, the granules are placed in an atmosphere with an oxygen concentration of 10% to 100%, at a temperature of 200° C. to 700° C., for 0.1 to 24 hours to obtain the target carrier core particles. More preferably, the granules are placed at a temperature of 250° C. to 600° C. for 0.5 to 20 hours, further more preferably, at a temperature of 300° C. to 550° C. for 1 to 12 hours. Note that the oxidation step is optionally executed when necessary.

Thus, the carrier core particles according to the embodiment of the invention are manufactured. The method for manufacturing the carrier core particles for electrophotographic developer according to the embodiment of the invention is a method for manufacturing carrier core particles containing iron and strontium as a core composition. The method includes a slurrying step of making an iron-containing raw material and a strontium-containing raw material into slurry, a granulation step of granulating the slurry mixture obtained in the slurrying step, and a firing step of firing a powdery material, which is obtained by granulating the slurry mixture in the granulation step, at a predetermined temperature to form a magnetic phase. The slurrying step makes the iron-containing raw material into the slurry containing the iron-containing raw material having a volume diameter $D_{50}$ of 1.0 to 4.0 μm and a volume diameter $D_{90}$ of 2.5 to 7.0 μm and makes the strontium-containing raw material into the slurry so that the carrier core particles for electrophotographic developer contain $0<y\leq5000$ ppm, where y denotes the content of the strontium in the carrier core particles.

The method for manufacturing the carrier core particles can provide carrier core particles that are small in diameter, have very few pores therein and have uniform crystal grains thereon. Therefore, the method can produce carrier core particles for electrophotographic developer that can be smaller in diameter, have crystals of appropriate size on the surface and achieve high strength.

In addition, the carrier core particles for electrophotographic developer according to the embodiment of the invention contain iron and strontium as a core composition and are manufactured by making an iron-containing raw material and a strontium-containing raw material into slurry, granulating the obtained slurry mixture, and firing a powdery material, which is obtained by granulating the slurry mixture, at a predetermined temperature to form a magnetic phase. The carrier core particles for electrophotographic developer are manufactured by making the iron-containing raw material into the slurry containing the iron-containing raw material having a volume diameter $D_{50}$ of 1.0 to 4.0 μm and a volume diameter $D_{90}$ of 2.5 to 7.0 μm and making the strontium-containing raw material into the slurry so that the carrier core particles for electrophotographic developer contain $0<y\leq5000$ ppm, where y denotes the content of the strontium in the carrier core particles.

Such carrier core particles for electrophotographic developer are small in diameter, have very few pores therein and have uniform crystal grains thereon. Thus, the carrier core particles manufactured by the aforementioned method can be smaller in diameter, have crystals of appropriate size on the surface and achieve high strength.

Furthermore, the carrier core particles for electrophotographic developer contain iron and strontium as a main core composition and the strontium content y in the carrier core particles for electrophotographic developer is $0<y\leq5000$ ppm. The carrier core particles have a mean particle diameter ranging from 20 μm to 30 μm. The carrier core particles have a BET specific surface area ranging from 0.15 $m^2/g$ to 0.25 $m^2/g$. The pore volume of the carrier core particles obtained by mercury porosimetry ranges from 0.003 ml/g to 0.023 ml/g.

Next, the carrier core particles obtained in the aforementioned manner are coated with resin (FIG. 1(G)). Specifically, the carrier core particles obtained according to the invention are coated with silicone-based resin, acrylic resin or the like. Finally, carrier for electrophotographic developer according to the embodiment of the invention is achieved. The silicone-based resin, acrylic resin or other coating materials can be coated through a well-known coating method. The carrier for electrophotographic developer according to the embodiment of the invention is contained in developer for electrophotography and includes the above-described carrier core particles for electrophotographic developer and resin that coats the surface of the carrier core particles for electrophotographic developer. The carrier for electrophotographic developer can be smaller in diameter and achieve high strength.

Next, the carrier thus obtained and toner in predetermined amounts are mixed (FIG. 1(H)). Specifically, the carrier, which is obtained through the above-described manufacturing method, for electrophotographic developer according to the embodiment of the invention is mixed with an appropriate well-known toner. In this manner, the electrophotographic developer according to the embodiment of the invention can be achieved. The carrier and toner are mixed by any type of mixer, for example, a ball mill. The electrophotographic developer according to the embodiment of the invention is used to develop electrophotographic images and includes the above-described carrier for electrophotographic developer and toner that can be triboelectrically charged by frictional contact with the carrier for development of electrophotographic images. The electrophotographic developer including the thus-composed carrier for electrophotographic developer can provide high quality images.

EXAMPLES

Example 1

10 kg of $Fe_2O_3$ (volume diameter $D_{50}$: 0.6 μm, volume diameter $D_{90}$: 3.0 μm) and 4 kg of $Mn_3O_4$ (volume diameter $D_{50}$: 0.3 μm, volume diameter $D_{90}$: 2.0 μm) were calcined at 900° C. for 2 hours and then pulverized by a vibratory ball mill for 1 hour. 14 kg of the calcined material were dispersed in 5 kg of water, and 84 g of ammonium polycarboxylate-based dispersant, 42 g of carbon black reducing agent and 103 g of $SrCO_3$ (volume diameter $D_{50}$: 1.0 μm, volume diameter $D_{90}$: 4.0 μm), which is a strontium-containing raw material, were added to make a mixture. The solid concentration of the mixture was measured and resulted in 74 wt %. The mixture was pulverized by a wet ball mill (media diameter: 2 mm) to obtain mixture slurry containing the calcined material having a volume diameter $D_{50}$ of 1.6 μm and a volume diameter $D_{90}$ of 3.1 μm. In this example, the iron-containing raw material is calcined material and the Sr was added to be 4350 ppm.

The slurry was sprayed into hot air of approximately 130° C. by a spray dryer and turned into dried granulated powder. At this stage, granulated powder particles out of the target particle size distribution were removed by a sieve. The remaining granulated powder was placed in an electric furnace and fired at 1130° C. for 3 hours. During firing, gas was controlled to flow in the electric furnace such that the atmosphere in the electric furnace was adjusted to have an oxygen concentration of 0.8%, in other words, 8000 ppm. The cooling temperature during the firing step was set to 2° C./min. The cooling rate during the firing step, specifically, the rate in which the material is cooled to room temperature after completion of the firing step was set to preferably 10° C./min. or lower, or more preferably 3° C./min. The fired powder was disintegrated and then classified by a sieve to obtain carrier core particles, of Example 1, having a mean particle diameter of 25 μm. The mean particle diameter herein is a volume mean diameter and is synonymous with volume diameter $D_{50}$. Table 1 shows the diameter of the material, or the fired material, the composition of the carrier core particles, and electrical characteristics and magnetic characteristics of the resultant carrier core particles. The composition of the carrier core particles shown in Table 1 is obtained by measuring the resultant carrier core particles by an analysis method as described later. The amount of the additive, or specifically, the strontium content y in the carrier core particles of Example 1 was 3400 ppm. For particle size measurement, Microtrac (Model 9320-X100) produced by NIKKISO CO., LTD. was used. For the oxygen concentration, a zirconia type oxygen analyzer (ECOAZ TB-II F-S, produced by DAIICHI NEKKEN CO., LTD) was used to measure the oxygen concentration under an atmosphere in the furnace.

(Analysis on Sr)

The strontium content in the carrier core particles was analyzed by a method below. The carrier core particles of the invention were dissolved in an acid solution and quantitatively analyzed with ICP. The content of strontium in the carrier core particles described in this invention is a quantity of strontium that was quantitatively analyzed with the ICP.

(Analysis on Mn)

The Mn content in the carrier core particle was quantitatively analyzed in conformity with a ferromanganese analysis method (potential difference titration) shown in JIS G1311-1987. The Mn content of the carrier core particles of the invention is a quantity of Mn that was quantitatively analyzed through the ferromanganese analysis method (potential difference titration).

As to the measurement of magnetization, which exhibits magnetic characteristics, shown in Table 1, magnetic susceptibility was measured with a VSM (Model VSM-P7 produced by Toei Industry Co., Ltd.). The item "$\sigma_{1k\ (1000)}$" indicates magnetization in an external magnetic field of 1k (1000) Oe.

The BET specific surface area was measured by using a single-point BET surface area analyzer (produced by Mountech CO., Ltd., Model: Macsorb HM model-1208). Specifically, samples, each of which was weighted to 8.500 g, were loaded to a 5-ml (cc) cell that was then degassed at 200° C. for 30 minutes to measure the specific surface area of the samples.

Pore volume was measured as follows. The test machine used was POREMASTER-60GT produced by Quantachrome Instruments. Specifically, samples, each of which was weighted to 1.200 g, were loaded to a 5-ml (cc) cell to measure the pore volumes under the following conditions: cell stem volume: 0.5 ml; head pressure: 20 PSIA; surface tension of mercury: 485.00 $erg/cm^2$; contact angle of mercury: 130.00 degrees; high-pressure measurement mode: fixed rate; motor speed: 1; and high-pressure measurement range: 20.00 to 10000.00 PSI. The pore volume was determined by subtracting Volume A (ml/g) at 100 PSI from Volume B (ml/g) at 10000.00 PSI.

The strength of the carrier core particles was measured as follows. 30 g of the carrier core particles of the invention were loaded in a sample mill (Model SK-M10 produced by KYORITSU RIKO KK) to conduct a pulverization test at 14000 rpm for 60 seconds. The ratios of cumulative volume changes of particles having a diameter of 22 μm or lower between before and after pulverization were measured by a laser diffraction particle size analyzer (Microtrac Model 9320-X100 produced by NIKKISO CO., LTD.) and the ratio values were defined as strength. The strength of the carrier core particles is higher as the values decrease.

Example 2

Carrier core particles of Example 2 were obtained in the same manner as in Example 1, but the calcined material used herein had a volume diameter $D_{50}$ of 1.0 μm and a volume diameter $D_{90}$ of 6.0 μm.

Example 3

Carrier core particles of Example 3 were obtained in the same manner as in Example 1, but the calcined material used herein had a volume diameter $D_{50}$ of 2.3 μm and a volume diameter $D_{90}$ of 6.0 μm, and 7.0 g of $SrCO_3$ was added.

Example 4

Carrier core particles of Example 4 were obtained in the same manner as in Example 1, but the calcined material used herein had a volume diameter $D_{50}$ of 3.0 μm and a volume diameter $D_{90}$ of 6.3 μm, and 34.6 g of $SrCO_3$ was added.

Example 5

Carrier core particles of Example 5 were obtained in the same manner as in Example 1, but the calcined material used herein had a volume diameter $D_{50}$ of 2.2 μm and a volume diameter $D_{90}$ of 5.7 μm.

Example 6

Carrier core particles of Example 6 were obtained in the same manner as in Example 1, but the calcined material used herein had a volume diameter $D_{50}$ of 3.5 μm and a volume diameter $D_{90}$ of 7.0 μm, and 95.1 g of $SrCO_3$ was added.

Example 7

Carrier core particles of Example 7 were obtained in the same manner as in Example 1, but the calcined material used herein had a volume diameter $D_{50}$ of 2.0 μm and a volume diameter $D_{90}$ of 6.9 μm.

Example 8

Carrier core particles of Example 8 were obtained in the same manner as in Example 4, but the calcined material used herein had a volume diameter $D_{50}$ of 3.3 μm and a volume diameter $D_{90}$ of 7.0 μm.

Comparative Example 1

Carrier core particles of Comparative Example 1 were obtained in the same manner as in Example 1, but the calcined material used herein had a volume diameter $D_{50}$ of 0.5 μm and a volume diameter $D_{90}$ of 2.0 μm, and the strontium-containing raw material was not added.

Comparative Example 2

Carrier core particles of Comparative Example 2 were obtained in the same manner as in Example 1, but the calcined material used herein had a volume diameter $D_{50}$ of 3.4 μm and a volume diameter $D_{90}$ of 9.5 μm.

Comparative Example 3

Carrier core particles of Comparative Example 3 were obtained in the same manner as in Example 1, but the calcined material used herein had a volume diameter $D_{50}$ of 2.2 μm and a volume diameter $D_{90}$ of 6.1 μm and 114.7 g of $SrCO_3$ was added.

[Table 1]

As shown in Table 1, values $\sigma_{1000}$, representing magnetic characteristics, of Examples 1 to 8 are: 58.8 emu/g, 58.5 emu/g, 59.2 emu/g, 58.9 emu/g, 57.2 emu/g, 56.5 emu/g, 57.2 emu/g, and 58.1 emu/g, respectively. All values are higher than 56.0 emu/g, which are high values. On the other hand, Comparative Examples 2 and 3 exhibit 55.0 emu/g and 54.3 emu/g, respectively. Both values are 55.0 emu/g or lower, which are low values. The remanent magnetization $\sigma_r$ of Comparative Example 3 is 2.5 emu/g, which is very high. It is inferred that this is because Sr added in a large amount formed a relatively large amount of strontium ferrite during the firing step. The carrier core particles with high remanent magnetization values have a strong tendency to inhibit appropriate formation of the magnetic brush, which is not preferable.

Figure 5:
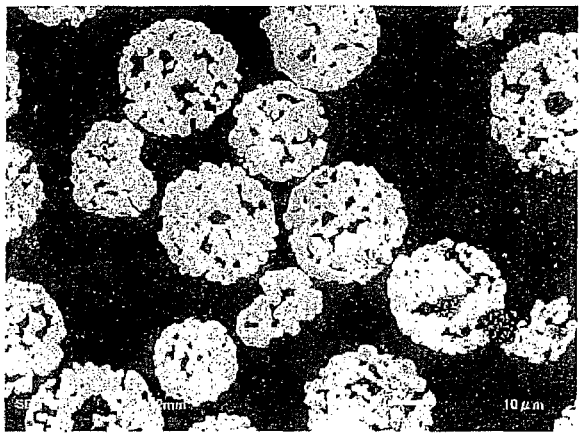
FIG. 5 is an electron micrograph showing the cross section of carrier core particles of Comparative Example 2.

In addition, Examples 1 to 8 have BET specific surface area values ranging from 0.15 $m^2/g$ to 0.25 $m^2/g$, and pore volume values obtained by mercury porosimetry ranging from 0.003 ml/g to 0.023 ml/g. These results show that the carrier core particles of Examples 1 to 8 have low pore volumes of 0.023 ml/g or lower, even though the carrier core particles have BET specific surface area values of 0.15 $m^2/g$ or higher, which are higher than that of the regular carrier core particles like Comparative Example 1. It has been found from the results that the carrier core particles of Examples 1 to 8 can maintain such high BET specific surface area values because they have very few large open pores, but have minute or micro pores, or they have grain boundaries or irregularities on the particle surface. On the other hand, it is inferred that Comparative Examples 2 and 3 have large pores as shown in FIG. 5, even though they have high BET specific surface area values. As a result, the strength values of Examples 1 to 8 are 2.2, 2.9, 2.5, 3.1, 4.2, 5.6, 5.2, respectively, all of which are 6.0 or lower. These low values indicate that the particles of Examples 1 to 8 have high strength. Comparative Examples 1 to 3 exhibit 6.5, 7.1, 10.2, respectively. These high values indicate that the particles of Comparative Examples 1 to 3 have low strength.

In order to achieve further strength, the following composition is effective. Let w ($m^2/g$) denote the BET specific surface area value and v (ml/g) the pore volume value by mercury porosimetry, the relationship $v \leq 0.63w^2 - 0.084w + 0.028$ is established. Note that value w is in the aforementioned range, or $0.15 \leq w \leq 0.25$, while value v is in the aforementioned range, or $0.003 \leq v \leq 0.023$. The carrier core particles whose BET specific surface area value and pore volume value by mercury porosimetry establish such a relationship can have more strength. Actually, the carrier core particles of Examples 1 to 6 having such a relationship exhibit the strength values less than 4.5, which indicate achievement of further strength.

In another preferable embodiment, the carrier core particles are composed so as to have 500 ppm<y≤3400 ppm, a mean particle diameter ranging from 20 μm to 30 μm, a BET specific surface area value ranging from 0.15 $m^2/g$ to 0.20 $m^2/g$, and a pore volume value by mercury porosimetry ranging from 0.003 ml/g to 0.012 ml/g. Such carrier core particles for electrophotographic developer can more reliably enhance particle strength while achieving high BET specific surface area values to improve adhesion property with the coating resin. Actually, Examples 1 to 4 achieved low strength values of 3.0 or below.

Figure 2:
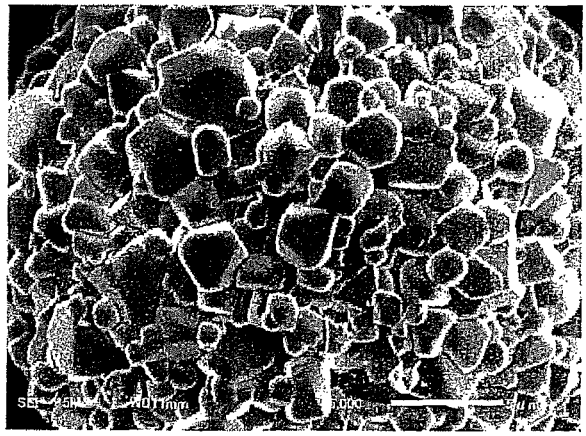
FIG. 2 is an electron micrograph showing the appearance of a carrier core particle of Example 1.
Figure 3:
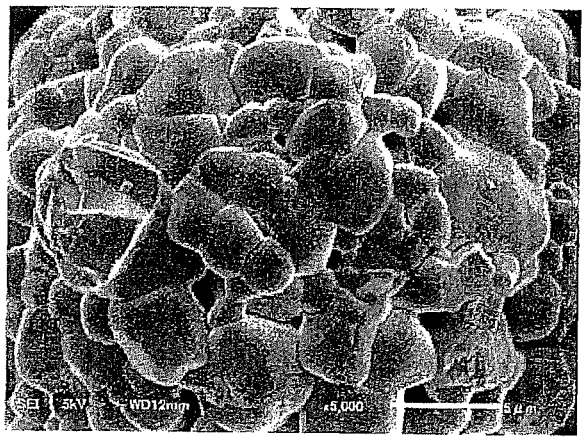
FIG. 3 is an electron micrograph showing the appearance of a carrier core particle of Comparative Example 2.
Figure 4:
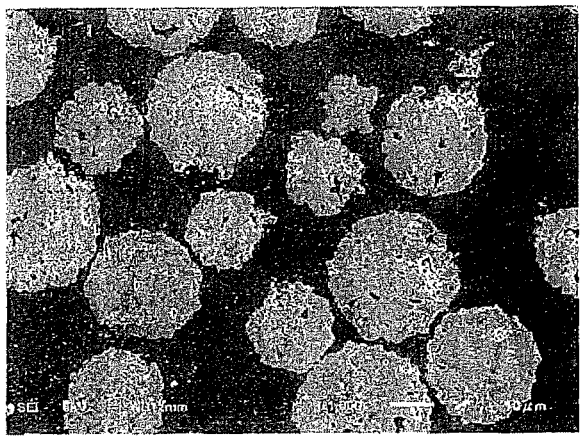
FIG. 4 is an electron micrograph showing the cross section of carrier core particles of Example 1.

FIG. 2 is an electron micrograph showing the appearance of a carrier core particle of Example 1. FIG. 3 is an electron micrograph showing the appearance of a carrier core particle of Comparative Example 1. FIG. 4 is an electron micrograph showing the cross section of carrier core particles of Example 1. FIG. 5 is an electron micrograph showing the cross section of carrier core particles of Comparative Example 2.

Referring to FIGS. 2 to 5, the carrier core particles of Example 1 have good surface properties. It can be seen that the particle has many crystal boundaries, moderate irregularities, and uniform crystal grains on the surface. It can be also seen that the carrier core particle of Example 1 has very few holes or pores inside the particle. On the other hand, the carrier core particle of Comparative Example 2 has fewer crystal boundaries than those of Example 1, and therefore the irregularity level is inadequate. In addition, it is apparent that a great number of holes or pores are present inside the carrier core particles of Comparative Example 2.

The above descriptions demonstrate the excellent characteristics of the carrier core particles for electrophotographic developer, carrier for electrophotographic developer and electrophotographic developer according to the invention.

Although manganese is used as a raw material of the carrier core particles in the embodiments, the carrier core particles can be made without manganese.

Although, $Fe_2O_3$ and $Mn_3O_4$ are calcined and then pulverized by a ball mill to be used as the iron-containing material in the embodiments, the present invention is not limited thereto. The iron-containing material may be simply unprocessed $Fe_2O_3$ or the like. In this case, the iron-containing material $Fe_2O_3$ having a volume diameter $D_{50}$ of 1.0 to 4.0 μm and a volume diameter $D_{90}$ of 2.5 to 7.0 μm is preferable to use.

The foregoing has described the embodiment of the present invention by referring to the drawings. However, the invention should not be limited to the illustrated embodiment. It should be appreciated that various modifications and changes can be made to the illustrated embodiment within the scope of the appended claims and their equivalents.

INDUSTRIAL APPLICABILITY

The carrier core particles for electrophotographic developer, the method for manufacturing the carrier core particles, carrier for electrophotographic developer and electrophotographic developer according to the invention can be effectively used when applied to copying machines or the like that require high image quality.

TABLE 1

| | DIAMETER OF MATERIAL PARTICLES | | MATERIAL CONTENTS | | | BET SPECIFIC SURFACE | PORE | MAGNETIC CHARACTERISTIC | | DIAMETER OF CARRIER CORE PARTICLES | |
|---|---|---|---|---|---|---|---|---|---|---|---|
| | $D_{50}$ μm | $D_{90}$ μm | Fe wt % | Mn wt % | Sr ppm | AREA $m^2/g$ | VOLUME ml/g | $\sigma_{1000}$ emu/g | $\sigma_r$ emu/g | $D_{50}$ μm | STRENGTH |
| EXAMPLE 1 | 1.6 | 3.1 | 49.4 | 19.7 | 3400 | 0.20 | 0.008 | 58.8 | 1.3 | 25 | 2.2 |
| EXAMPLE 2 | 1.0 | 6.0 | 49.3 | 19.9 | 3400 | 0.20 | 0.012 | 58.5 | 1.5 | 26 | 2.9 |
| EXAMPLE 3 | 2.3 | 6.0 | 51.5 | 20.6 | 500 | 0.15 | 0.003 | 59.2 | 0.9 | 24 | 2.5 |
| EXAMPLE 4 | 3.0 | 6.3 | 51.3 | 20.5 | 1900 | 0.15 | 0.006 | 58.9 | 1.0 | 26 | 2.4 |
| EXAMPLE 5 | 2.2 | 5.7 | 49.6 | 19.7 | 3400 | 0.25 | 0.015 | 57.2 | 1.6 | 25 | 3.1 |
| EXAMPLE 6 | 3.5 | 7.0 | 51.2 | 20.4 | 5000 | 0.25 | 0.023 | 56.5 | 1.8 | 25 | 4.2 |
| EXAMPLE 7 | 2.0 | 6.9 | 51.5 | 20.0 | 3400 | 0.20 | 0.020 | 57.2 | 1.9 | 25 | 5.6 |
| EXAMPLE 8 | 3.3 | 7.0 | 51.3 | 20.2 | 1900 | 0.15 | 0.013 | 58.1 | 1.3 | 25 | 5.2 |
| COMPARATIVE EXAMPLE 1 | 0.5 | 2.0 | 51.3 | 20.3 | 0 | 0.09 | 0 | 59.0 | 0.5 | 25 | 6.5 |
| COMPARATIVE EXAMPLE 2 | 3.4 | 9.5 | 49.3 | 19.6 | 3400 | 0.25 | 0.030 | 55.0 | 1.8 | 26 | 7.1 |
| COMPARATIVE EXAMPLE 3 | 2.2 | 6.1 | 51.3 | 19.8 | 6000 | 0.28 | 0.028 | 54.3 | 2.5 | 25 | 10.2 |

The invention claimed is:

1. Carrier core particles for electrophotographic developer, the carrier core particles having a core composition consisting of iron, manganese, and strontium, comprising:

0<y≤5000 ppm, where y denotes the content of the strontium in the carrier con particles;

a mean particle diameter ranging from 20 μm to 30 μm;

a BET specific surface area ranging from 0.15 $m^2/g$ to 0.25 $m^2/g$; and a pore volume obtained by mercury porosimetry ranging from 0.003 ml/g to 0.023 ml/g.

2. The carrier core particles for electrophotographic developer according to claim 1, wherein a relationship $v \leq 0.63w^2 - 0.084w + 0.028$ is established, letting w ($m^2/g$) denote a BET specific surface area and v (ml/g) a pore volume obtained by mercury porosimetry.

3. Carrier for electrophotographic developer used in electrophotographic developer, comprising:

the carrier core particles for electrophotographic developer cited in claim 2; and resin that coats the surface of the carrier core particles for electrophotographic developer.

4. Electrophotographic developer used to develop electrophotographic images, comprising:

the carrier for electrophotographic developer cited in claim 3; and toner that can be triboelectrically charged by frictional contact with the carrier for development of electrophotographic images.

5. The carrier core particles for electrophotographic developer according to claim 1, wherein $D_{50}<D_{90}$.

* * * * *